US011576428B2

(12) United States Patent
Inagaki et al.

(10) Patent No.: US 11,576,428 B2
(45) Date of Patent: Feb. 14, 2023

(54) SMOKING ARTICLE FILTER AND METHOD OF MANUFACTURING THE SAME

(71) Applicant: JAPAN TOBACCO INC., Tokyo (JP)

(72) Inventors: Michihiro Inagaki, Tokyo (JP); Hiroshi Shibuichi, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 359 days.

(21) Appl. No.: 16/710,110

(22) Filed: Dec. 11, 2019

(65) Prior Publication Data

US 2020/0107574 A1 Apr. 9, 2020

Related U.S. Application Data

(63) Continuation of application No. PCT/JP2018/023061, filed on Jun. 18, 2018.

(30) Foreign Application Priority Data

Jun. 19, 2017 (JP) ..... JP2017-119642

(51) Int. Cl.

| | |
|---|---|
| ***A24D 3/02*** | (2006.01) |
| ***A24D 3/04*** | (2006.01) |
| *A24D 3/10* | (2006.01) |
| *A24D 3/12* | (2006.01) |
| *A24D 3/16* | (2006.01) |

(52) U.S. Cl.

CPC ..... *A24D 3/04* (2013.01); *A24D 3/0212* (2013.01); *A24D 3/10* (2013.01); *A24D 3/12* (2013.01); *A24D 3/16* (2013.01)

(58) Field of Classification Search

None

See application file for complete search history.

(56) References Cited

U.S. PATENT DOCUMENTS 3,128,680 A 4/1964 Schaaf, Jr.
4,007,745 A * 2/1977 Randall ..... A24D 3/0204 131/331

(Continued)

FOREIGN PATENT DOCUMENTS

CN 1258225 A 6/2000
CN 1612701 A 5/2005

(Continued)

OTHER PUBLICATIONS

Russian Office Action and Search Report, dated Jul. 2, 2020, for Russian Application No. 202010032, with an English translation.

(Continued)

*Primary Examiner* — Dennis R Cordray

(74) *Attorney, Agent, or Firm* — Birch, Stewart, Kolasch & Birch, LLP

(57) ABSTRACT

A smoking article filter comprising: a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface; a plurality of particles arranged in the air flow paths; and a filter wrapping paper wrapping the filter material such that the side surface is covered with the filter wrapping paper.

19 Claims, 4 Drawing Sheets

(56) References Cited

U.S. PATENT DOCUMENTS

| | | | | |
|---|---|---|---|---|
| 4,488,563 | A * | 12/1984 | Morifuji | A24D 3/043 405/36 |
| 5,185,052 | A | 2/1993 | Chappell et al. | |
| 5,365,951 | A | 11/1994 | Arterbery et al. | |
| 6,432,340 | B1 * | 8/2002 | Vassilatos | C08L 77/00 264/176.1 |
| 2001/0052224 | A1 | 12/2001 | Gelderland et al. | |
| 2002/0189625 | A1 | 12/2002 | Bushby et al. | |
| 2004/0237982 | A1 * | 12/2004 | Dollhopf | A24D 3/10 131/331 |
| 2004/0237983 | A1 * | 12/2004 | Sasaki | A24D 3/16 131/345 |
| 2007/0235046 | A1 | 10/2007 | Gedevanishvili | |
| 2011/0094526 | A1 | 4/2011 | Marshall et al. | |
| 2013/0213421 | A1 * | 8/2013 | Crooks | A24D 3/068 156/73.2 |
| 2014/0238425 | A1 | 8/2014 | Kaljura et al. | |
| 2016/0106147 | A1 * | 4/2016 | Lisan | A24D 3/04 493/43 |

FOREIGN PATENT DOCUMENTS

| | | | |
|---|---|---|---|
| CN | 205947106 | U | 2/2017 |
| EP | 1470761 | A1 | 10/2004 |
| GB | 2118423 | B | 5/1986 |
| JP | 55-29932 | A | 3/1980 |
| JP | 6-64983 | A | 3/1994 |
| JP | 7-8254 | A | 1/1995 |
| JP | 9-294577 | A | 11/1997 |
| JP | 2759606 | B2 | 3/1998 |
| JP | 2003-515356 | A | 5/2003 |
| KR | 10-0912311 | B1 | 8/2009 |
| KR | 10-2012-0089313 | A | 8/2012 |
| RU | 2605833 | C2 | 12/2016 |
| WO | WO 03/056947 | A1 | 7/2003 |
| WO | WO 2016/108119 | A1 | 7/2016 |

OTHER PUBLICATIONS

English translation of the International Preliminary Report on Patentability and Written Opinion of the International Searching Authority for Application No. PCT/JP2018/023061, dated Jan. 2, 2020.

Office Action dated May 19, 2021, in Republic of Korea Patent Application No. 10-2019-7035874.

Office Action dated Apr. 23, 2020, in Taiwan Patent Application No. 107120948.

Lanying et al., "Chemical Unit Operation Process and Equipment vol. II," South China University of Technology Press, Aug. 31, 2010, pp. 263-264.

Office Action dated Dec. 16. 2021, in Chinese Patent Application No. 201880040732.X.

International Search Report, issued in PCT/JP2018/023061, PCT/ISA/210, dated Aug. 28, 2018.

Written Opinion of the International Searching Authority, issued in PCT/JP2018/023061, PCT/ISA/237, dated Aug. 28, 2018.

Chinese Office Action and Search Report, dated Apr. 8, 2021, for Chinese Application No. 201880040732.X, with English machine translations.

Extended European Search Report, dated Apr. 26, 2021, for European Application No. 18820095.0.

* cited by examiner

SMOKING ARTICLE FILTER AND METHOD OF MANUFACTURING THE SAME

CROSS-REFERENCE TO RELATED APPLICATIONS

This application is a Continuation Application of PCT Application No. PCT/JP2018/023061 filed Jun. 18, 2018 and based upon and claiming the benefit of priority from Japanese Patent Application No. 2017-119642 filed Jun. 19, 2017, the entire contents of which are incorporated herein by reference.

BACKGROUND OF THE INVENTION

1. Field of the Invention Field

The present invention relates to a smoking article filter and a method of manufacturing the same.

2. Description of the Related Art

As a smoking article filter, an acetate filter is generally used in which a cellulose acetate fiber bundle (acetate tow) is used as a filter material. Meanwhile, as a smoking article filter, a film filter is known in which the film filter is formed by pleating a film material, folding it to form air flow paths longitudinally, and wrapping it with a filter wrapping paper (for example, refer to U.K. Patent No. 2118423, and Jpn. Pat. Appln. KOKAI Publication No. H9-294577). The film filter has characteristics of showing, as compared to the acetate filter, higher permeation rates of components that contribute greatly to a smoking flavor, allowing a user to easily savor the smoking flavor during smoking.

BRIEF SUMMARY OF THE INVENTION

The present inventors focused on the matter that the reason why the film filter is not widely used for a smoking article is that the film filter is insufficient in filter firmness and filter draw resistance as compared to the acetate filter. Insufficient filter firmness causes the user to have less feeling of use (e.g., less gripping comfort or less holding comfort with the lips), while insufficient filter draw resistance causes the user to feel difficulties in inhalation. Therefore, an object of the present invention is to provide a smoking article film filter having sufficient filter firmness and sufficient filter draw resistance while maintaining the filtration property of the film filter.

According to one aspect, there is provided with a smoking article filter comprising:

a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface;

a plurality of particles arranged in the air flow paths; and a filter wrapping paper wrapping the filter material such that the side surface is covered with the filter wrapping paper.

According to another aspect, there is provided with a smoking article filter, comprising:

a low-filtration filter material having a tar filtration rate of 40% or less when a filter draw resistance is 90 $mmH_2O$;

a plurality of particles arranged in voids of the low-filtration filter material; and a filter wrapping paper wrapping the low-filtration filter material.

According to further another aspect, there is provided with a smoking article comprising the above-mentioned smoking article filter.

According to further another aspect, there is provided with a cigarette, comprising:

the above-mentioned smoking article filter;

a tobacco rod including a tobacco filler and connected to one end of the filter; and a tipping paper wrapped on the filter and the tobacco rod to connect the filter and the tobacco rod.

According to further another aspect, there is provided with a method of manufacturing a smoking article filter, comprising:

adding a plurality of particles on a corrugated film;

forming a filter material by gathering the corrugated film to have a plurality of air flow paths in a longitudinal direction and have a circular cylinder shape as a whole, thereby arranging the particles in the air flow paths; and wrapping the filter material with a filter wrapping paper to obtain a filter.

According to the present invention, it is possible to provide a smoking article film filter having sufficient filter firmness and sufficient filter draw resistance while maintaining the filtration property of the film filter.

DETAILED DESCRIPTION OF THE INVENTION

Hereinafter, the present invention will be described, but the following description is for the purpose of detailed explanation of the present invention, and is not intended to limit the present invention.

1. Smoking Article Filter

Figure 1:
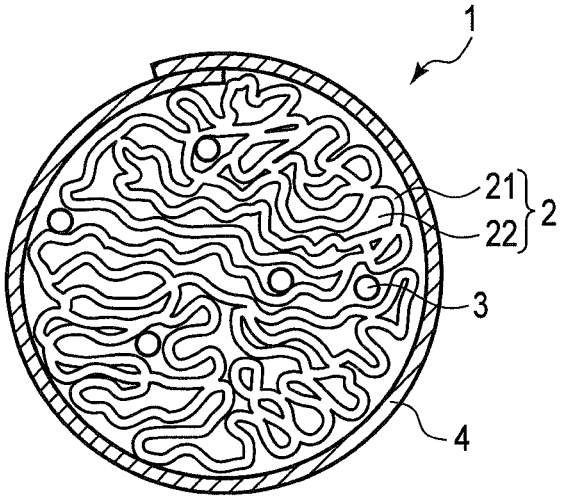
FIG. 1 is a cross-sectional view showing an example of a smoking article filter.

FIG. 1 shows a cross section of an example of a smoking article filter. As shown in FIG. 1, a smoking article filter 1 includes:

a filter material 2 having a circular cylinder shape with first and second end surfaces and a side surface, and including a corrugated film 21 with ridge portions and valley portions arranged alternately, the ridge portions and valley portions extending from the first end surface to the second end surface to form a plurality of air flow paths 22 that allow air to flow from the first end surface to the second end surface;

a plurality of particles 3 arranged in the air flow paths 22; and a filter wrapping paper 4 wrapping the filter material such that the side surface is covered with the filter wrapping paper.

According to another aspect, a smoking article filter 1 includes:

a filter material 2 formed by gathering a corrugated film 21 to have a plurality of air flow paths 22 in a longitudinal direction and have a circular cylinder shape as a whole;

a plurality of particles 3 arranged in the air flow paths 22; and a filter wrapping paper 4 wrapping the filter material 2.

In the following description, the smoking article filter may also simply be referred to as a filter.

The filter material has a circular cylinder shape with first and second end surfaces and a side surface. The filter material is formed by gathering a corrugated film in such a manner that a plurality of air flow paths are formed in a longitudinal direction (gathering process), and the filter material is wrapped with a filter wrapping paper. Thus, the first and second end surfaces look as if there are pores because of the presence of the air flow paths. The first and second end surfaces are not exactly flat, and, to be exact, the side surface has roughness on the surface. The first and second end surfaces do not have to be exactly perfect circles, and may be ellipses.

Figure 2:
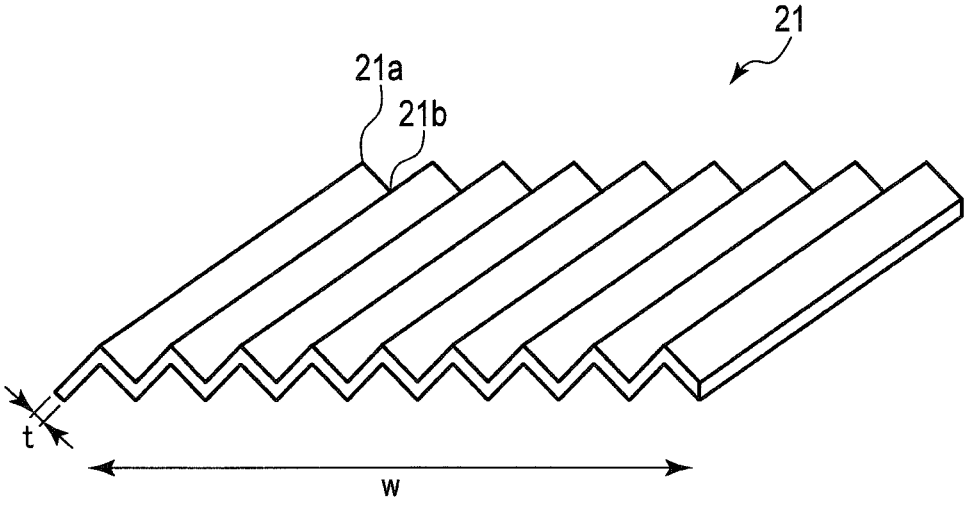
FIG. 2 is a view showing a film thickness and a film width of a corrugated film.

A corrugated film 21 constituting the filter material refers to a film with bellows-like pleats, i.e., a film in which ridge portions 21*a* and valley portions 21*b* are arranged alternately (see FIG. 2). The ridge portions and the valley portions of the corrugated film extend from the first end surface to the second end surface of the filter material to form a plurality of air flow paths that allow air to flow from the first end surface to the second end surface.

The corrugated film can be prepared by subjecting a film to a publicly-known process of adding bellows-like pleats. Such a process is also referred to as a pleating process, a crimping process, or a creping process, and is publicly known. For example, Jpn. Pat. Appln. KOKAI Publication No. H9-294577 discloses the process of adding pleats by passing the raw material sheet of the tobacco paper filter between the pair of pleat rollers.

Preferably, the corrugated film is a film formed of a melted film material. The method of forming a film of a melted film material is publicly-known, examples of which include a T-die method (casting method) and an inflation method. The film may be stretched uniaxially or biaxially after formed of the melted film material.

If the corrugated film is a film formed of a melted film material, the film is substantially impermeable to air. In this case, the corrugated film is not formed of an aggregate of fibers (e.g., paper or non-woven fabric). That is, the corrugated film is not a film formed into a sheet shape by applying a compression force or heat to fibers.

If the corrugated film is formed of a melted film material, it has characteristics of being dense in the surface, as compared to when the corrugated film is formed of an aggregate of fibers. Such film characteristics (i.e., dense surface characteristics) contribute to preventing particles arranged in the air flow paths from being buried in the film in the thickness direction. If the particles are arranged in the air flow paths without being buried in the film, the particles can efficiently contribute to an increase in the filter draw resistance, and can also efficiently contribute to an increase in the filter firmness.

More preferably, the corrugated film is a high molecular polymer film. Still more preferably, the corrugated film is a plastic film. Specifically, the corrugated film is a polyolefin film or a polyester film. More specifically, the corrugated film is a polypropylene film, a polybutylene succinate film, a polybutylene succinate adipate film, a polyethylene film, a polyvinyl chloride film, a polyethylene telephthalate film, a polylactic acid film, a cellulose acetate film, or a film formed of two or more types of materials constituting these films. The corrugated film can also be a biodegradable film. If the corrugated film is formed of two or more types of film materials, the corrugated film can be prepared by combining (mixing) film materials in the form of raw material pellets, and melting them into a film. Thus, if a corrugated film is formed of two or more types of film materials, it is possible to adjust various physical properties such as heat resistance or tensile elongation of the corrugated film.

The corrugated film generally has a thickness of 30 μm to 200 μm, preferably 30 μm to 100 μm. The thickness refers to the thickness of the film before the pleating process. When the film has a thickness within the above-indicated range, a partial damage (break) does not likely occur during the pleating process.

The corrugated film generally has a corrugation pitch of 0.5 mm to 1.5 mm, preferably 0.5 mm to 1.0 mm. The corrugation pitch refers to an average value of the distance between adjacent pleats when the pleats of the corrugated film are stretched to be flat. If the corrugation pitch exceeds 1.5 mm, it becomes difficult to achieve a perfect circle cross section when the corrugated film is gathered to form a circular cylinder shape as a whole. A pitch of less than 0.5 mm is not preferable in terms of the pleating accuracy and the durability of the pleating roller.

In one corrugated film, it is preferable that pleats (i.e., corrugations) are provided in a regular manner (i.e., at the same pitch) over the entire area of the film.

The corrugated film has a tensile elongation of 100% or more in general, preferably 100% to 1000%, more preferably 150% to 800%. The tensile elongation refers to a value measured by conducting a tensile test on the film before the pleating process. The tensile elongation can be determined by conducting a tensile test according to ASTM D882 and applying the test result to the following formula:

$$\text{tensile elongation (\%)} = 100 \times (L - L_0)/L_0$$

(where L represents a film length at break, and $L_0$ represents an initial film length (before test))

If the film has a tensile elongation within the above-noted range, a partial damage (break) does not likely occur during the pleating process. If a damage (break) occurs in the corrugated film, the corrugated film partially transmits air, resulting in an increase in a tar/nicotine filtration rate per filter draw resistance when the filter is formed with the film.

Figure 3:
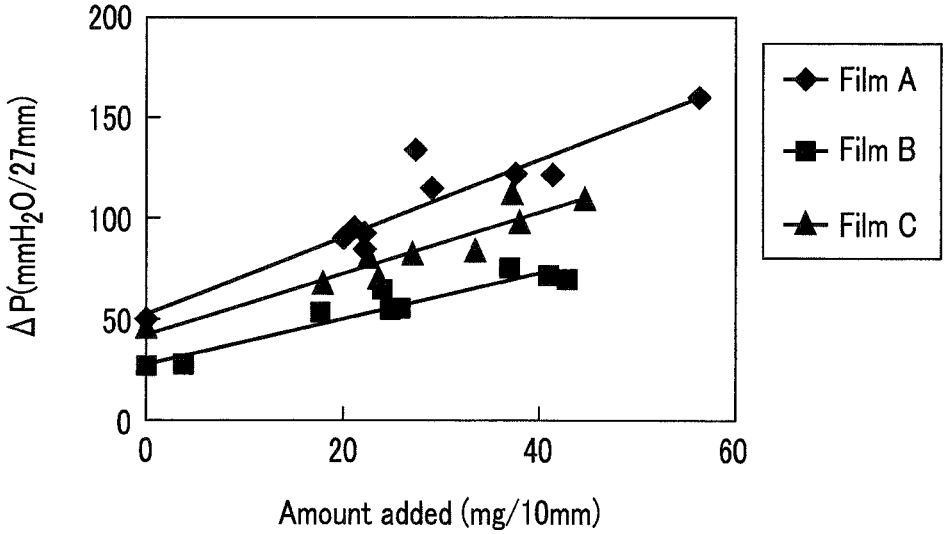
FIG. 3 is a graph showing a relationship between an amount of particles added and a filter draw resistance.

Moreover, if the film has a large tensile elongation, the filter prepared has a large filter draw resistance (see FIG. 3). Therefore, the filter draw resistance can be adjusted by selecting a film material based on the tensile elongation characteristics.

The above-described corrugated film is gathered so as to have a plurality of air flow paths in the longitudinal direction and also have a circular cylinder shape as a whole, thereby forming a filter material. That is, the filter material is formed of the corrugated film, has a plurality of air flow paths running in the longitudinal direction defined by the voids in the corrugated film, and has a circular cylinder shape as a whole.

The filling level of the corrugated film into the filter, i.e., the filling ratio of the corrugated film is preferably 10 to 40%, more preferably 20 to 40%. The "filling ratio" is defined by the following formula:

$$\text{filling ratio (\%)}=\{(\text{film thickness}\times\text{film width})/\text{filter cross-sectional area}\}\times 100$$

The film thickness and the film width of the corrugated film are denoted by t and w, respectively, in FIG. 2. The film width (w) refers to the width of the film measured with the pleats being extended.

If the filling ratio is less than 10%, the particles arranged in the air flow paths are barely held in the air flow paths, and easily fall off. Further, in this case, because of the high proportion of the air flow paths, it is necessary to add a large amount of particles to adjust the draw resistance, and as a result, the filter surface is likely to be uneven. On the other hand, if the filling ratio exceeds 40%, it becomes difficult to form a filter at a high speed due to resilience of the film, and puncture easily occurs at a wrapped portion glued at the time of wrapping with a filter wrapping paper. The filling ratio can be appropriately adjusted within the above-described range in consideration of the filter firmness and filter draw resistance to be achieved.

If the filter material is formed by gathering a corrugated film, the filter material may be formed by gathering a single corrugated film in a circular cylinder shape in a manner that it is folded, or the filter material may be formed by gathering a plurality of corrugated films in a circular cylinder shape.

As described above, if the filter material is formed by gathering the corrugated film, the voids in the corrugated film form a plurality of air flow paths running in the longitudinal direction. In the present invention, plurality of particles are arranged in the air flow path. When the particles are arranged in the air flow paths, the particles contribute to an increase in the filter firmness and the filter draw resistance of the film filter (see FIGS. 3 and 4). It is preferable that the particles are arranged so as to fill in the air flow paths while not being buried in the corrugated film, and this can efficiently contribute to an increase in the filter firmness and an increase in the filter draw resistance.

The particles have a particle diameter of preferably 10 to 70 mesh (i.e., 1.7 mm to 0.212 mm openings), more preferably 12 to 70 mesh (i.e., 1.4 mm to 0.212 mm openings), more preferably 10 to 42 mesh (i.e., 1.7 mm to 0.355 mm openings), based on JIS Z8801-1 (2006). A particle diameter of 10 to 70 mesh refers to a size of a particle that passes through a 10-mesh sieve but not a 70-mesh sieve.

The particles having a particle diameter within the above-described range can fill in the air flow paths to efficiently contribute to the increase in the filter draw resistance, and they are easily held in the air flow paths in a reliable manner without use of a binder such as an adhesive or a plasticizer. If particles not passing through the 10-mesh sieve are used, particle unevenness likely appears on the filter surface, which may affect the gluing quality in the process of gluing the tipping paper for connecting the filter to the tobacco rod. If particles passing through a sieve with openings one size smaller than the 70-mesh sieve are used, the particles likely fall off the filter cut end surface.

The particles may be arranged in the air flow paths without use of a binder such as an adhesive or a plasticizer, or may be arranged in the air flow paths using a binder. Examples of the adhesive used as a binder include: polyvinyl acetate; polyvinyl alcohol; polyethylene glycol; water-soluble esters or ethers; polysaccharides such as pectin, agar, starch, guar gum, carrageenan, gellan gum, xanthan gum, locust bean gum, arabic gum, tamarind gum, alginic acid, or alginates; fats and oils; natural polymers (e.g., protein); waxes such as paraffin; and cellulose derivatives such as CMC (carboxymethyl cellulose), HEC (hydroxyethyl cellulose), or HPMC (hydroxypropyl methyl cellulose). The plasticizer used as a binder may be a substance having plasticity to the film used. For the plasticizer, for example, triacetin or triethyl citrate can be used for the cellulose acetate film.

If a binder is used, the falling of particles can be reduced. A binder can be applied to the film surface or the particle surface. By selecting a type of the binder to be used, it is possible to selectively remove a specific component among components in the smoke, and to realize a more preferable smoking flavor.

In the case of using a film having characteristics of being melted with an increased temperature without use of a binder, heat is applied to the filter before or after the filter is formed, to partially melt the film, thereby increasing the contact area with the particles or partially fusing the film with the particles, so that the particles can be held in the air flow paths in a reliable manner.

The particles are contained in an amount of preferably 20 to 100 mg, more preferably 20 to 60 mg, still more preferably 20 to 50 mg, per 10 mm filter length, when the circumference of the filter is 24.0 mm. The amount of particles added can be appropriately adjusted within the above-described range in consideration of a filter draw resistance to be achieved.

If the filter circumference changes, the amount of particles added can be calculated so that the amount of particles added per filter volume is the same.

Specifically, amount Ax [mg] of particles added when a filter circumference is X [mm] can be calculated by the following formula:

$$A_x=A_{24}\times V_x/V_{24}$$

(where $A_{24}$ is an amount [mg] of particles added when the filter circumference is 24.0 mm, $V_x$ is a filter volume [$mm^3$] when the filter circumference is X [mm], and $V_{24}$ is a filter volume [$mm^3$] when the filter circumference is 24.0 mm)

For example, if the filter circumference is 20.0 mm, the particles are contained in an amount of preferably 13.9 to 41.7 mg, more preferably 20.8 to 34.7 mg, per 10 mm filter length.

The particles are preferably those having a relatively low adsorption performance with respect to whole vapor phase components of mainstream smoke, i.e., particles having a relatively small specific surface area. Specifically, particles having a BET specific surface area of 1 to 500 $m^2/g$ are preferable, and particles having a BET specific surface area of 1 to 100 $m^2/g$ are more preferable. The lower limit of 1 $m^2/g$ indicates the detection limit or below.

The particles may also be low adsorbent particles that do not substantially remove whole vapor phase components of mainstream smoke. When such low adsorbent particles are added to the filter material formed of the corrugated film, the low filtration performance of the filter material and the low adsorption performance of the particles can provide the user with an enhanced tobacco flavor (i.e., increased feeling of satisfaction).

Examples of the low adsorbent particles include particles selected from cellulose particles, cellulose acetate particles, calcium carbonate particles, activated carbon particles with low degree of activation, non-activated carbon particles, and the combination of these particles. These particles do not substantially remove any vapor phase components of mainstream smoke.

For the cellulose particles and the cellulose acetate particles, reference can be made to WO2013/084661.

The cellulose acetate particles may have any average acetylation degree, but the cellulose triacetate particles having a high average acetylation degree of 2.76 to 3.0 are preferable in terms of not adsorbing various volatile flavor components present in a cigarette pack during storage of cigarettes. The average acetylation degree can be measured according to a titration method: ASTM D871-96. The acetyl substitution degree of cellulose acetate obtained by this measuring method shows a normal distribution, and is therefore defined as "average acetylation degree". For example, cellulose acetate particles can be prepared by using commercially available cellulose triacetate flakes as a raw material, pulverizing them to a desired particle diameter using a pulverizer such as a mill, and classifying them using a sieve. Another preparation method may be using commercially available cellulose triacetate flakes as a raw material, pulverizing them using a pulverizer such as a mill, performing compression molding of the obtained powder with a compression-type granulator, further pulverizing the obtained molded body, and classifying them.

The cellulose particles can be prepared by using commercially available cellulose powder of microcrystalline cellulose, etc. as a raw material, performing compression molding of it with a compression-type granulator, pulverizing the obtained molded body, and classifying them.

The activated carbon particles with low degree of activation can be activated carbon particles having a BET specific surface area of 300 to 1000 $m^2/g$. Further, the non-activated carbon particles can be carbon particles having a BET specific surface area of 1 to 300 $m^2/g$.

Alternatively, the particles may be selective adsorbent particles that selectively remove a specific stimulating component from vapor phase components of mainstream smoke. When such selective adsorbent particles are added to the filter material formed of the corrugated film, the low filtration performance of the filter material and the selective component removal performance of the particles can provide the user with an enhanced tobacco flavor (i.e., increased feeling of satisfaction) while stimulation is suppressed.

Such selective adsorbent particles are, for example, particles selected from particles of hydrotalcite compound, and particles of anion exchange resin (e.g., anion exchange resin Amberlite commercially available from Organo Corporation). In particular, the particles of hydrotalcite compound can selectively remove aldehyde compounds from the vapor phase components of mainstream smoke.

The particles of hydrotalcite compound are particles of publicly-known compound having a layered structure similar to that of hydrotalcite. For example, reference can be made to WO2003/056947.

The hydrotalcite compound is represented by the following general formula:

$$[M^{2+}_{1-x}M^{3+}_{x}(OH)_2][(A^{n-})_{x/n}.mH_2O]$$

where $M^{2+}$ is a divalent metal ion selected from the group consisting of Mg, Zn, Ni and Ca ions; $M^{3+}$ is Al ion; A $n^-$ is an n-valent anion selected from the group consisting of $CO_3$, $SO_4$, OOC—COO, Cl, Br, F, $NO_3$, $Fe(CN)_6^{3-}$ $Fe(CN)_6^{4-}$, phthalic acid, isophthalic acid, terephthalic acid, maleic acid, alkenyl acid and a derivative thereof, malic acid, salicylic acid, acrylic acid, adipic acid, succinic acid, citric acid and sulfonic acid anions; x satisfies $0.1<x<0.4$; and m satisfies $0<m<2$.

In the above general formula, it is preferable that $M^{2+}$ is an Mg ion, $M^{3+}$ is an Al ion, $A^{n-}$ is $CO_3^{2-}$ or $SO_4^{2-}$, x satisfies $0.1<x<0.4$, and m satisfies $0<m<2$. The Mg—Al based hydrotalcite compound is stable in the case where the value of x falls within the range of 0.20 to 0.33. The above general formula is most preferably $Mg_6Al_2(OH)_{16}CO_3.4H_2O$.

The Mg—Al based hydrotalcite compound can be prepared by adding an alkali carbonate or both an alkali carbonate and a caustic alkali to an aqueous solution containing a water-soluble magnesium salt and either a water-soluble aluminum salt selected from aluminum sulfate, aluminum acetate and alum or aluminic acid, and carrying out the reaction while maintaining the pH of the reaction mixture at 8.0 or more. The obtained hydrotalcite compound can be pulverized and classified, thereby preparing particles of hydrotalcite compound.

The particles of hydrotalcite compound and the particles of anion exchange resin (e.g., anion exchange resin Amberlite commercially available from Organo Corporation) can be granulated and classified to be processed to have a preferred particle diameter. For a granulation method, granulation by extrusion molding or granulation by compression molding is preferable because it is easy to produce particles having a BET specific surface area of 500 $m^2/g$ or less. In particular, granulation by extrusion molding is preferable because it is easy to produce particles having a BET specific surface area of 100 $m^2/g$ or less.

As described above, the particles can not only contribute to an increase in the filter firmness and an increase in the filter draw resistance, but also change the filtration rates of the vapor phase components of mainstream smoke by changing the type or the amount added. For example, the above-mentioned low adsorbent particles and the above-mentioned selective adsorbent particles can be used in combination. In this case, while the low adsorbent particles do not substantially remove any vapor phase components of mainstream smoke, the selective adsorbent particles contribute to selectively removing the stimulating component. Thereby, it is possible to selectively remove the stimulating component while maintaining the filtration property of the film filter.

Alternatively, from the viewpoint of increasing variations in the smoking flavor of the smoking article, instead of the above-described low adsorbent particles and selective adsorbent particles, it is possible to use non-selective adsorbent particles having an ability to extensively remove whole vapor phase components of mainstream smoke without selectivity, such as particles of activated carbon, zeolite, porous aluminum oxide or silica gel. For the activated carbon, one obtained by activating, pulverizing, and classifying a raw material of a coconut shell, palm or coal may be used. In this case, the BET specific surface area of the activated carbon can be 1000 to 1800 $m^2/g$. By combining the low tar filtration property of the film filter and the high adsorption property of the vapor phase components of the non-selective adsorbent particles, it is possible to develop a new smoking flavor that has not been achieved in the past.

The filter according to the present invention includes the above-described filter material formed of the corrugated film and having air flow paths, the above-described particles arranged in the air flow paths, and a filter wrapping paper wrapping the filter material. As the filter wrapping paper, a filter wrapping, paper generally used for wrapping an acetate tow filter material can be used.

As described above, the filter according to the present invention includes the filter material formed of the corrugated film and having air flow paths, and the particles arranged in the air flow paths. With such a structure, the filter according to the present invention can have lower filtration rates of the whole components of mainstream smoke, and can achieve the sufficient filter firmness and the sufficient filter draw resistance. Therefore, the smoking article including the filter according to the present invention can provide the user with gripping comfort and holding comfort with the lips, without any sense of discomfort, and can also provide the user with moderate inhalation resistance and enhanced tobacco feeling (increased inhaling satisfaction).

The filter according to the present invention has a circumference of preferably 16 to 26 mm, more preferably 24 to 26 mm. That is, the filter has a diameter of preferably 5.1 to 8.3 mm, more preferably 7.6 to 8.3 mm.

For a sufficient filter firmness, the filter can have a firmness of 2 to 10 [mm*10]. For a sufficient filter draw resistance, the filter can have a draw resistance of 50 to 140 $mmH_2O$ per 10 mm filter length.

For the filter firmness, the filter firmness measuring device manufactured by Cerulean Corporation is used with a load of 300 g and a pressing surface having an area of 113 $mm^2$ and a round shape, to measure an amount of deformation [mm]($\Delta D$) when the filter is pressed for 10 seconds. From the measured value, the filter firmness can be calculated by the following formula.

$$\text{filter firmness [mm*10]} = \Delta D \times 10$$

Before the filter firmness is measured, the filter is left for 12 hours or more under the conditions of a temperature of 22° C. and a humidity of 60%, and then the measurement is performed.

By setting the filter firmness to 10 [mm*10] or less, i.e., "firmness that is not too soft", the user can feel gripping comfort, holding comfort with the lips, and biting comfort, all without any sense of discomfort. In addition, by setting the filter firmness to 10 [mm*10] or less, unexpected filter deformation does not occur, for example, when ash is removed by tapping a cigarette during smoking, or when a cigarette is put out by pressing cigarette fire on the ashtray at the end of smoking. Further, by setting the filter firmness to 2 [mm*10] or more, i.e., "firmness that is not too firm", the step of gluing and connecting the cigarette rod and the filter rod with the tipping paper when the cigarette is manufactured can be performed at a high speed using an existing cigarette manufacturing apparatus.

The filter draw resistance is measured according to an ISO standard method (ISO 6565) by using, for example, the filter draw resistance measuring device manufactured by Cerulean Corporation. The filter draw resistance indicates the pressure difference between the first and second end surfaces when air of a predetermined air flow rate (17.5 cc/sec) flows from one end surface (first end surface) to the other end surface (second end surface) while no air passes through the side surface of the filter. The unit is generally represented by $mmH_2O$. The relationship between the filter draw resistance and the filter length is known to be a proportional relationship in the normally used length range (5 mm to 200 mm), and if the length is doubled, the filter draw resistance is doubled.

By setting the filter draw resistance within the above-described range, it is possible to realize inhalation resistance that does not cause a sense of discomfort when the user smokes a smoking article (e.g., cigarette).

According to another aspect, the smoking article filter according to the present invention includes:

a low-filtration filter material having a tar filtration rate of 40% or less when a filter draw resistance is 90 $mmH_2O$;

a plurality of particles arranged in voids of the low-filtration filter material; and a filter wrapping paper wrapping the low-filtration filter material.

The "tar filtration rate (%) when the filter draw resistance is 90 $mmH_2O$" can be obtained in the following manner. The tar filtration rate (E_tar) (unit: %) in the filter is calculated by the following formula, using the tar generation amount (Tar_0) of the cigarette in the case where the filter to be evaluated about tar filtration rate is not connected, and the tar generation amount (Tar_1) of the cigarette in the case where the above filter is connected.

$$E_tar[\%] = \{(Tar_0 - Tar_1)/Tar_0\} \times 100$$

Further, the tar permeation rate (%) in the filter is represented by the formula: 100−E_tar.

For the measurement of tar amount, smoking was carried out using a constant volume automatic smoking machine of piston type (RM20/CS manufactured by Borgwaldt KC, Inc.) under the conditions of a puff volume of 17.5 ml/second, a puff duration of 2 seconds/puff and a puff frequency of 1 puff/minute. Nicotine and crude tar in the smoke that had passed through the filter were collected with the glass fiber filter (Cambridge filter), and a "nicotine amount" and a "moisture weight" were measured using a gas chromatograph (7890A manufactured by Agilent). The amount of tar was measured by a gravimetric method. The difference between the weight of the glass fiber filter before smoking and that after smoking is a crude tar weight, and from the crude tar weight, the nicotine weight and the moisture weight were subtracted to thereby obtain the "tar amount".

The low-filtration filter material having a tar filtration rate of 40% or less when the filter draw resistance is 90 $mmH_2O$ is, for example, the filter material described above, that is, a filter material that has a circular cylinder shape with first and second end surfaces and a side surface, and includes a corrugated film with ridge portions and valley portions arranged alternately, in which the ridge portions and valley portions extend from the first end surface to the second end surface to form a plurality of air flow paths that allow air to flow from the first end surface to the second end surface. In other words, the low-filtration filter material having a tar filtration rate of 40% or less when the filter draw resistance is 90 $mmH_2O$ is, for example, a filter material formed by gathering the corrugated film to have a plurality of air flow paths in the longitudinal direction and have a circular cylinder shape as a whole.

In a conventional fiber-filled layer filter (i.e., acetate filter), the tar filtration rate when the filter draw resistance is 90 $mmH_2O$ is approximately 55%. The filter according to the present invention has a similar draw resistance to that of the conventional fiber-filled layer filter, but can achieve a tar filtration rate greatly lower than that of the conventional fiber-filled layer filter. Thus, the present invention can realize a smoking article having an inhalation resistance without a sense of discomfort, and excellent in the tobacco flavor. Specifically, when the above-mentioned "low adsorbent particles" are used as particles, it is possible to realize a smoking article having an inhalation resistance without a sense of discomfort, and an enhanced tobacco flavor. Alternatively, when the above-mentioned "selective adsorbent particles" are used as particles, it is possible to realize a smoking article having an inhalation resistance without a sense of discomfort, and an enhanced tobacco flavor while suppressing stimulation. Alternatively, when the above-mentioned "non-selective adsorbent particles" are used as particles, it is possible to realize a smoking article having an inhalation resistance without a sense of discomfort, and a new tobacco flavor that has not been achieved in the past.

2. Smoking Article

According to another aspect, there is provided a smoking article including the smoking article filter according to the present invention. Examples of the smoking article include: a combustion type smoking article, such as a cigarette, which burns a tobacco filler; a heat-not-burn type smoking article, which heats without burning a tobacco filler; and a non-heating type smoking article, where flavor components of a tobacco filler are inhaled without burning or heating the tobacco filler. Examples of the heat-not-burn type smoking article include: a carbonaceous heat source type inhalation article that heats a tobacco filler with combustion heat of a carbon heat source (see, for example, WO2006/073065); an electrical heating type inhalation article provided with an inhaler and a heating device for electrically heating the inhaler (see, for example, WO2010/110226); and a liquid atomization type inhalation article that atomizes, by heating, a liquid aerosol source containing a smoking flavor source (see, for example, WO2015/046385). Examples of the non-heating type smoking article include: a flavor inhaler which comprises an inhalation holder and a tobacco filler filled in the main flow path of the inhalation holder and where flavor components of the tobacco filler are inhaled (see, for example, WO2010/095659).

The cigarette according to the present invention includes:

the smoking article filter according to the present invention;

a tobacco rod including a tobacco filler and connected to one end of the filter; and a tipping paper wrapped on the filter and the tobacco rod to connect the filter and the tobacco rod.

As described above, the smoking article according to the present invention is provided with the filter according to the present invention, making it possible to provide the user with a gripping comfort, holding comfort with the lips, and biting comfort, all without a sense of discomfort, and also moderate inhalation resistance and enhanced tobacco feeling.

3. Method of Manufacturing Smoking Article Filter

A method of manufacturing a smoking article filter according to the present invention includes steps of:

adding a plurality of particles on a corrugated film;

forming a filter material by gathering the corrugated film to have a plurality of air flow paths in a longitudinal direction and have a circular cylinder shape as a whole, thereby arranging the particles in the air flow paths; and wrapping the filter material with a filter wrapping paper to obtain a filter.

This method can be carried out using a publicly-known filter rod manufacturing apparatus, for example, using the apparatus disclosed in Jpn. Pat. Appln. KOKAI Publication No. H1-243979 or Jpn. Pat. Appln. KOKAI Publication No. H9-294577.

This method may include a step of gluing an overlap portion of the filter wrapping paper after the filter material is wrapped with the filter wrapping paper.

Further, this method may include a step of spraying a liquid additive (i.e., a liquid binder) containing a binder such as an adhesive or a plasticizer on the corrugated film after the step of adding a plurality of particles on the corrugated film. Specifically, this method may include the step of applying a liquid additive containing a binder such as an adhesive or a plasticizer to the surface of the corrugated film and the surfaces of the particles by a spray or the like, between the step of adding a plurality of particles on the corrugated film and the step of forming a filter material by gathering the corrugated film to have a plurality of air flow paths in the longitudinal direction and have a circular cylinder shape as a whole. Alternatively, this method may include a step of applying a liquid additive containing a binder such as an adhesive or a plasticizer to the surface of the corrugated film by a spray or the like, before the step of adding a plurality of particles on the corrugated film. Including the step of applying the binder allows the particles to be reliably held in the air flow paths.

In addition, this method may further include a step, after the step of wrapping the filter material with the filter wrapping paper to obtain a filter, of heating the obtained filter. Specifically, after the step of wrapping the filter material with the filter wrapping paper to obtain a filter, the filter obtained by wrapping the filter material with the filter wrapping paper can be subjected to a step of placing the filter into a treatment container having a high environment temperature for a predetermined time, a step of heating by a microwave, or a step of heating through application of hot air. By including any of these steps, if a liquid additive containing a binder is added, it is possible to promote drying of the liquid additive containing the binder, whereas if a liquid additive containing a binder is not added, the film surface is partially melted to increase the adhesion area between the particles and the film, thereby reliably holding the particles on the film.

In addition, this method may further include a step of heating the corrugated film in advance to moderately semi-melt the surface of the corrugated film before the step of adding a plurality of particles on the corrugated film. Specifically, by heating in advance a pair of metal crepe rollers that adds corrugations on the film, it is possible to heat the film concurrently with being formed into a corrugated shape, and to moderately semi-melt the surface of the film. This increases the adhesion area between the added particles and the film, and the particles can be reliably held on the film.

4. Multi-Segment Filter

The smoking article filter according to the present invention may be used as a plain filter (i.e., monofilter), or as a filter segment of a multi-segment filter. If the filter according to the present invention is used as a filter segment of a multi-segment filter, the remaining filter segment(s) can be aligned in the longitudinal direction with the filter according to the present invention, thereby forming a multi-segment filter. For the remaining filter segments, for example, a filter formed of a normal cellulose acetate fiber-filled layer, a hollow paper tube containing no filtering material, a molded body formed of plastic or metal, etc. can be used.

Selecting filter segments used in combination with the filter according to the present invention, or the order of upstream/downstream arrangements can be determined in accordance with various purposes. For example, if a smoker is familiar with the appearance of the filter formed of the conventional cellulose acetate fiber-filled layer, in order to prevent him or her from feeling uncomfortable with the appearance of the mouthpiece end surface of the filter, the filter according to the present invention can be arranged as an upstream segment, while the filter formed of the cellulose acetate fiber-filled layer can be arranged as a downstream segment. This makes it possible to prevent the smoker from feeling uncomfortable with the appearance of the mouthpiece end surface while achieving the effect obtained by the filter according to the present invention. Further, if a filter segment including a member having a flavor releasing function (e.g., flavor granules) and the filter according to the present invention are used in combination, it is possible to broaden flavor variations of the smoking article.

In the case of the multi-segment filter, the length of each filter segment can be appropriately selected in accordance with the purpose, and the number of filter segments can be appropriately selected in accordance with the purpose. A filter in which two segments are combined is generally called a dual filter, while a filter in which three segments are combined is generally called a triple filter. A multi-segment filter may be manufactured by, for example, preparing each filter segment and cutting the filter segments into a predetermined length, followed by wrapping them up with an outer filter wrapping paper.

5. Preferable Embodiments

The preferable embodiments are summarized below.

[1] A smoking article filter comprising:

a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface;

a plurality of particles arranged in the air flow paths; and a filter wrapping paper wrapping the filter material such that the side surface is covered with the filter wrapping paper.

[2] A smoking article filter comprising:

a filter material formed by gathering a corrugated film to have a plurality of air flow paths in a longitudinal direction and have a circular cylinder shape as a whole;

a plurality of particles arranged in the air flow paths; and a filter wrapping paper wrapping the filter material.

[3] The smoking article filter according to [1] or [2], wherein the corrugated film is a film formed of a melted film material.

[4] The smoking article filter according to [3], wherein the corrugated film is a film substantially impermeable to air.

[5] The smoking article filter according to any one of [1] to [4], wherein the corrugated film has a thickness of 30 μm to 200 μm, preferably 30 μm to 100 μm.

[6] The smoking article filter according to any one of [1] to [5], wherein the corrugated film has a tensile elongation of 100% or more, preferably 100 to 1000%, more preferably 150 to 800%.

[7] The smoking article filter according to any one of [1] to [6], wherein the corrugated film has a corrugation pitch of 0.5 mm to 1.5 mm, preferably 0.5 mm to 1.0 mm.

[8] The smoking article filter according to any one of [1] to [7], wherein the corrugated film is contained at a filling ratio of 10 to 40%, preferably 20 to 40%.

[9] The smoking article filter according to any one of [1] to [8], wherein the particles have a particle diameter of 10 to 70 mesh, preferably 12 to 70 mesh, preferably 10 to 42 mesh, based on JIS Z8801-1 (2006).

[10] The smoking article filter according to any one of [1] to [9], wherein the particles are contained in an amount of 20 to 100 mg, preferably 20 to 60 mg, more preferably 20 to 50 mg, per 10 mm filter length, when a circumference of the filter is 24.0 mm.

[11] The smoking article filter according to any one of [1] to [10], wherein the smoking article filter has a circumference of 16 to 26 mm, preferably 24 to 26 mm.

[12] The smoking article filter according to any one of [1] to [10], wherein the smoking article filter has a diameter of 5.1 to 8.3 mm, preferably 7.6 to 8.3 mm.

[13] The smoking article filter according to any one of [1] to [12], wherein the corrugated film is a high molecular polymer film.

[14] The smoking article filter according to any one of [1] to [13], wherein the corrugated film is a plastic film.

[15] The smoking article filter according to any one of [1] to [14], wherein the corrugated film is a polyolefin film or a polyester film.

[16] The smoking article filter according to any one of [1] to [15], wherein the film is a film selected from a polypropylene film, a polybutylene succinate film, a polybutylene succinate adipate film, a polyethylene film, a polyvinyl chloride film, a polyethylene telephthalate film, a polylactic acid film, a cellulose acetate film, and a film formed of two or more types of materials constituting said films.

[17] The smoking article filter according to any one of [1] to [16], wherein the corrugated film is a biodegradable film.

[18] The smoking article filter according to any one of [1] to [17], wherein the particles are particles having a BET specific surface area of 1 to 500 $m^2/g$, preferably 1 to 100 $m^2/g$.

[19] The smoking article filter according to any one of [1] to [18], wherein the particles are particles selected from cellulose particles, cellulose acetate particles, calcium carbonate particles, activated carbon particles with low degree of activation, non-activated carbon particles, and a combination of said particles.

[20] The smoking article filter according to any one of [1] to [19], wherein the particles are particles selected from particles of hydrotalcite compound and particles of anion exchange resin.

[21] The smoking article filter according to any one of [1] to [20], wherein the particles are particles of hydrotalcite compound represented by the following general formula:

$$[M^{2+}_{1-x}M^{3+}_{x}(OH)_2][(A^{n-})_{x/n}, mH_2O]$$

where $M^{2+}$ is a divalent metal ion selected from the group consisting of Mg, Zn, Ni and Ca ions; $M^{3+}$ is Al ion; $A^{n-}$ is an n-valent anion selected from the group consisting of $CO_3$, $SO_4$, OOC—COO, Cl, Br, F, $NO_3$, $Fe(CN)_6^{3-}$ $Fe(CN)_6^{4-}$, phthalic acid, isophthalic acid, terephthalic acid, maleic acid, alkenyl acid and a derivative thereof, malic acid, salicylic acid, acrylic acid, adipic acid, succinic acid, citric acid and sulfonic acid anions; x satisfies $0.1<x<0.4$; and m satisfies $0<m<2$.

[22] The smoking article filter according to [21], wherein $M^{2+}$ is an Mg ion, $M^{3+}$ is an Al ion, $A^{n-}$ is $CO_3^{2-}$ or $SO_4^{2-}$, x satisfies $0.1<x<0.4$, and m satisfies $0<m<2$, in the general formula.

[23] The smoking article filter according to [22], wherein x falls within the range of 0.20 to 0.33.

[24] The smoking article filter according to [21], wherein the general formula is $Mg_6Al_2(OH)_{16}CO_3.4H_2O$.

[25] The smoking article filter according to any one of [1] to [24], wherein the particles are particles selected from activated carbon particles, zeolite particles, porous aluminum oxide particles, silica gel particles, and a combination of said particles.

[26] The smoking article filter according to any one of [1] to [18], wherein the particles are a combination of the particles recited in [19] and the particles recited in any one of [20] to [24].

[27] The smoking article filter according to any one of [1] to [26], wherein the particles is arranged in the air flow paths via a binder.

[28] The smoking article filter according to any one of [1] to [26], wherein the binder is an adhesive or a plasticizer.

[29] The smoking article filter according to any one of [1] to [28], wherein the smoking article filter has a draw resistance of 50 to 140 $mmH_2O$ per 10 mm filter length.

[30] The smoking article filter according to any one of [1] to [29], wherein the smoking article filter has a firmness of 2 to 10 mm*10.

[31] A smoking article filter, comprising:

a low-filtration filter material having a tar filtration rate of 40% or less when a filter draw resistance is 90 $mmH_2O$;

a plurality of particles arranged in voids of the low-filtration filter material; and a filter wrapping paper wrapping the low-filtration filter material.

[32] The smoking article filter according to [31], wherein the low-filtration filter material is a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface.

[33] The smoking article filter according to [31], wherein the low-filtration filter material is a filter material formed by gathering a corrugated film to have a plurality of air flow paths in a longitudinal direction and have a circular cylinder shape as a whole.

[34] A smoking article comprising the smoking article filter according to any one of [1] to [33].

[35] The smoking article according to [34], wherein the smoking article is a combustion type smoking article which burns a tobacco filler.

[36] The smoking article according to [34], wherein the smoking article is a heat-not-burn type smoking article which heats without burning a tobacco filler.

[37] The smoking article according to [36], wherein the heat-not-burn type smoking article is a carbonaceous heat source type inhalation article that heats a tobacco filler with combustion heat of a carbon heat source; an electrical heating type inhalation article provided with an inhaler and a heating device for electrically heating the inhaler; or a liquid atomization type inhalation article that atomizes, by heating, a liquid aerosol source containing a smoking flavor source.

[38] The smoking article according to [34], wherein the smoking article is a non-heating type smoking article where flavor components of a tobacco filler are inhaled without burning or heating the tobacco filler.

[39] The smoking article according to [38], wherein the non-heating type smoking article is a flavor inhaler which comprises an inhalation holder and a tobacco filler filled in the main flow path of the inhalation holder and where flavor components of the tobacco filler are inhaled.

[40] A cigarette, comprising:

the smoking article filter according to any one of [1] to [33];

a tobacco rod including a tobacco filler and connected to one end of the filter; and a tipping paper wrapped on the filter and the tobacco rod to connect the filter and the tobacco rod.

[41] A method of manufacturing a smoking article filter, comprising steps of:

adding a plurality of particles on a corrugated film;

forming a filter material by gathering the corrugated film to have a plurality of air flow paths in a longitudinal direction and have a circular cylinder shape as a whole, thereby arranging the particles in the air flow paths; and wrapping the filter material with a filter wrapping paper to obtain a filter.

[42] The method according to [41], wherein the smoking article filter is the smoking article filter according to any one of [1] to [33].

[43] The method according to [41] or [42], further comprising a step of gluing an overlap portion of the filter wrapping paper after the step of wrapping the filter material with a filter wrapping paper to obtain a filter.

[44] The method according to any one of [41] to [43], further comprising a step of spraying a liquid binder on the corrugated film after the step of adding the plurality of particles on the corrugated film.

[45] The method according to any one of [41] to [43], further comprising a step of spraying a liquid binder on the corrugated film before the step of adding the plurality of particles on the corrugated film.

[46] The method according to [44] or [45], wherein the liquid binder comprises an adhesive or a plasticizer as a binder.

[47] The method according to any one of [41] to [46], further comprising a step of heating the filter after the step of wrapping the filter material with the filter wrapping paper to obtain the filter.

[48] The method according to any one of [41] to [46], further comprising a step of heating the filter before the step of wrapping the filter material with the filter wrapping paper to obtain the filter.

[49] The method according to any one of [41] to [46], further comprising a step of heating the corrugated film before the step of adding the plurality of particles on the corrugated film.

EXAMPLES

Example 1

1. Preparation of Filter 1-1. Preparation of Corrugated Film

Films A to C described below were used to prepare corrugated films.

Film A: Polypropylene film (purchased from Mitsui Chemicals Tohcello, Inc.)

thickness: 50 μm tensile elongation: 700%

Film B: Polybutylene succinate film FZ91 (purchased from Mitsubishi Chemical Corporation)

thickness: 50 μm tensile elongation: 160%

Film C: Polybutylene succinate adipate film FD92 (purchased from Mitsubishi Chemical Corporation)

thickness: 50 μm tensile elongation: 380%

As the films A to C wound around the bobbins were being unwound, they passed between a pair of grooved crepe rolls (embossing rolls) for pleating. Each of the grooved crepe rolls has, on the surface, a plurality of grooves extending in parallel in the circumferential direction with pitch of 1 mm. Thereby, multiple grooves (bellows-like pleats) were added to the film along the film traveling direction, and corrugated films A to C were prepared.

1-2. Preparation of Particles-Containing Filter Material

Using the corrugated films A to C (film width (w): 260 mm), particles-containing filter materials A to C were prepared in the following manner.

For particles, particles of hydrotalcite compound (grade: G-7, purchased from Kyowa Chemical Industry Co., Ltd.) were used. The particles had a particle diameter of 10-42 mesh and a BET specific surface area of 65 $m^2/g$. The particles were added onto the corrugated films in the amount of 20 mg to 45 mg per 10 mm filter length.

Thereafter, the corrugated films were gathered to have air flow paths in the longitudinal direction and have a circular cylinder shape as a whole, thereby preparing particles-containing filter materials. In this manner, particles-containing filter materials A to C having particles arranged in the air flow paths were prepared.

On the other hand, filter materials A to C were formed of the corrugated films A to C by the same method except that no particles were added. The filter materials A to C had a tar filtration rate of approximately 30 to 35% when the filter draw resistance was 90 $mmH_2O$.

1-3. Preparation of Filter

The particles-containing filter materials A to C were wrapped with filter wrapping papers (papers made mainly from wood pulp, thickness of 110 μm, basis weight of 52 $g/m^3$, air permeability of 7000 [CU]) to prepare filters A to C.

The filters A to C had a diameter of 7.7 mm, a circumference of 24.1 mm, and a length of 120 mm. Further, in the filters A to C, the filling ratio of the corrugated film was 28%.

2. Evaluations 2-1. Evaluation 1 (Relationship Between the Amount of Particles Added and the Filter Draw Resistance)

For each of the filters A to C, the amount of particles added was changed to examine the relationship between the amount of particles added and the filter draw resistance.

The filter draw resistance was measured according to an ISO standard method (ISO 6565) using, for example, a filter draw resistance measuring device manufactured by Cerulean Corporation.

FIG. 3 shows the relationship between the amount of particles added and the filter draw resistance. In FIG. 3, the amount of particles added indicates the amount added per 10 mm filter length. In FIG. 3, the filter draw resistance is represented by draw resistance [$mmH_2O$] per 27 mm filter length. Because the filter draw resistance is proportional to the filter length, if a draw resistance value per 10 mm filter length is to be obtained, for example, a draw resistance [$mmH_2O$] per 27 mm filter length is multiplied by 10/27, thereby obtaining a draw resistance [$mmH_2O$] per 10 mm filter length.

For all filters A to C, the filter draw resistance increased as the amount of particles added increased. Comparing the filters A to C, the filter draw resistance was larger as the film tensile elongation was larger. These results show that a desired filter draw resistance can be designed by adjusting the types of the film (tensile elongation) and the amount of particles added.

2-2. Evaluation 2 (Relationship Between the Amount of Particles Added and the Filter Firmness)

For each of the filters A to C, the amount of particles added was changed to examine the relationship between the amount of particles added and the filter firmness.

The filter firmness was measured as follows.

For the filter firmness, the filter firmness measuring device manufactured by Cerulean Corporation was used with a load of 300 g and a pressing surface having an area of 113 $mm^2$ and a round shape, to measure an amount of deformation [mm]($\Delta D$) when the filter was pressed for 10 seconds. From the measured value, the filter firmness was calculated by the following formula.

$$\text{filter firmness [mm*10]} = \Delta D \times 10$$

Before the filter firmness was measured, the filter was left for 12 hours or more under the conditions of a temperature of 22° C. and a humidity of 60%, and then the measurement was performed.

Figure 4:
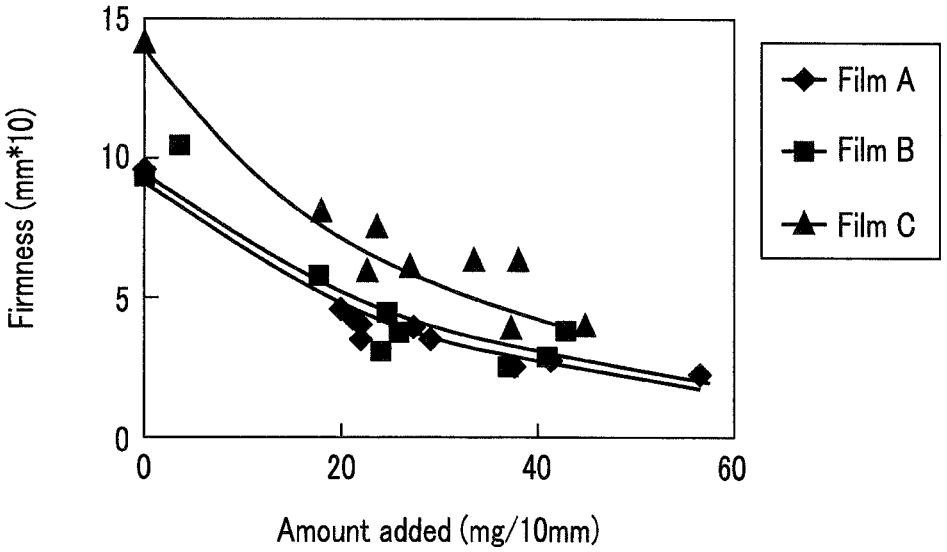
FIG. 4 is a graph showing a relationship between an amount of particles added and a filter firmness.

FIG. 4 shows the relationship between the amount of particles added and the filter firmness. In FIG. 4, the amount of particles added indicates the amount added per 10 mm filter length. For all filters A to C, the filter firmness increased in association with the increase in the amount of particles added. In addition, comparing the filters A to C, the films A and B easily expressed the filter firmness as compared to the film C. These results show that a desired filter firmness can be designed by adjusting the types of the film (material) and the amount of particles added.

2-3. Evaluation 3 (Relationship Between Filter Draw Resistance and Tar Permeation Rate)

For each of the filters A to C, the filter draw resistance was changed to examine the relationship between the filter draw resistance and the tar permeation rate. As a control, also for the conventional acetate filter, the relationship between the filter draw resistance and the tar permeation rate was examined.

The filter draw resistance was measured according to an ISO standard method (ISO 6565) using the filter draw resistance measuring device manufactured by Cerulean Corporation.

The tar permeation rate was measured by connecting the filters A to C whose filter draw resistances were changed and the conventional acetate filter to the tobacco rod in the following manner.

The filters A to C and the conventional acetate filter were cut into a length of 20 mm. The cut filters were connected, with cellophane tape, to the tobacco rod part of the commercially-available MEVIUS SUPER LIGHTS (JAPAN TOBACCO INC.) from which the filter was removed, with their end surfaces closely attached to each other. Next, acetate filters for cigarette sample preparation having the same circumference as those of the filters A to C were cut into a length of 7 mm (in which the filters include, as the filter material, the cellulose acetate fiber having a filament denier of 5.5 denier, a filter cross-sectional shape of Y cross section, and a total denier of 31000 denier, and contain 6% of triacetin as a plasticizer with respect to the fiber weight). The cut filters were closely attached to the end surfaces of the filters A to C not connected to the tobacco rod, and connected with cellophane tape. For the 20 mm-length filters A to C, the conventional acetate filter, and the 7 mm-length acetate filters for cigarette sample preparation, the entire side surfaces were covered with cellophane tape so as not to cause air leakage.

The tar filtration rate of the filter whose tar permeation rate is to be evaluated was obtained in the following manner. First, the tar filtration rate (E_tar) was calculated by the following formula, using the tar generation amount (Tar_0) of the cigarette in the case where the filter to be evaluated about tar permeation rate is not connected (i.e., cigarette in which only the 7 mm-length acetate filter for cigarette sample preparation is connected to the tobacco rod part of MEVIUS SUPER LIGHTS), and the tar generation amount (Tar_1) of the cigarette in the case where the filter to be evaluated about tar permeation rate is connected (i.e., cigarette in which the filter obtained by cutting any of the filters A to C and the conventional acetate filter into a length of 20 mm and the 7 mm-length acetate filter for cigarette sample preparation are connected to the tobacco rod part of MEVIUS SUPER LIGHTS).

$$Tar \text{ filtration rate}(E_tar)=\{(Tar_0-Tar_1)/Tar_0\}$$

The tar permeation rate was calculated from value of the tar filtration rate (E_tar) by the following formula:

$$Tar \text{ permeation rate}=1-E_tar$$

For the measurement of tar amount and nicotine amount, smoking was carried out using a constant volume automatic smoking machine of piston type (RM20/CS manufactured by Borgwaldt KC, Inc.) under the conditions of a puff volume of 17.5 ml/second, a puff duration of 2 seconds/puff and a puff frequency of 1 puff/minute. Nicotine and crude tar in the smoke that had passed through the filter were collected with the glass fiber filter (Cambridge filter), and a "nicotine amount" and a "moisture weight" were measured using a gas chromatograph (7890A manufactured by Agilent). The amount of tar was measured by a gravimetric method. The difference between the weight of the glass fiber filter before smoking and that after smoking is a crude tar weight, and from the crude tar weight, the nicotine weight and the moisture weight were subtracted to thereby obtain the "tar amount".

Figure 5:
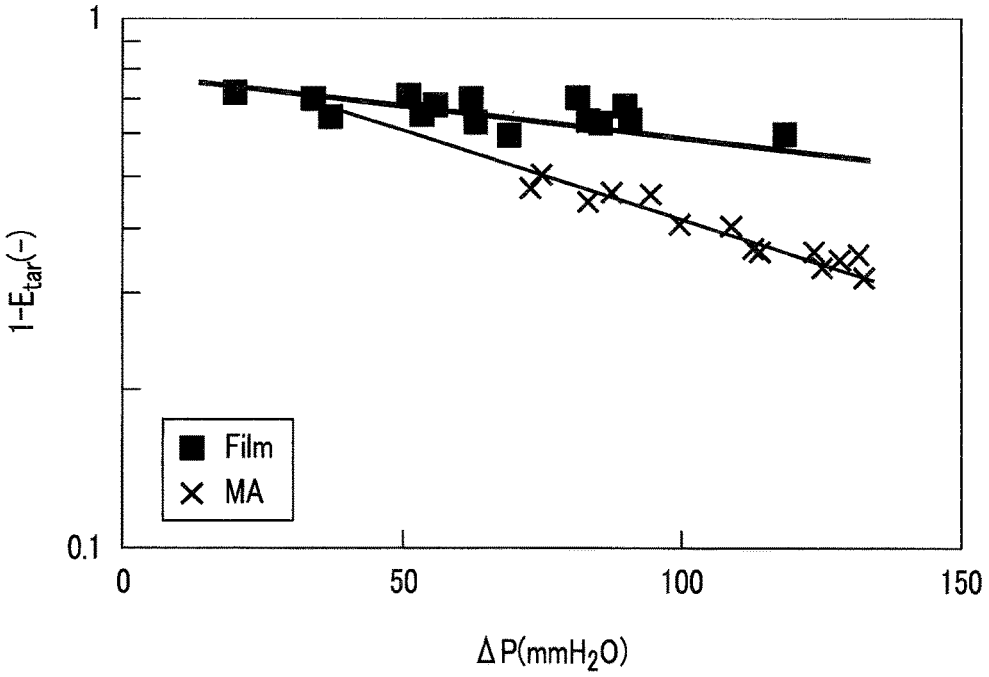
FIG. 5 is a graph showing a relationship between a filter draw resistance and a tar permeation rate.

FIG. 5 shows the relationship between the filter draw resistance and the tar permeation rate. In FIG. 5, "film" represents the filters A to C, and "MA" represents the acetate filter formed of the cellulose acetate fiber-filled layer. In FIG. 5, the results of the filters A to C are shown without distinction.

The filters A to C had a higher tar permeation rate as compared to that of the acetate filter. This result shows that even if particles are added, the filter according to the present invention can maintain the film filter characteristics of low filtration rate.

If the filter according to the present invention attempts to obtain the same filter draw resistance as that of the acetate filter, the tar permeation rate becomes higher than that of the acetate filter. If a cigarette is prepared by connecting, to the tobacco rod, the filter according to the present invention and the acetate filter which have different tar permeation rates, the proportion (Vf) of the amount of air flowing in from the through-holes of the tipping paper of the cigarette to which the filter according to the present invention is connected is increased and adjusted, so that the tar delivery amount from each cigarette can be equivalent. In this manner, the filter according to the present invention can achieve a low CO/tar ratio. In addition, the present invention makes it possible to design cigarettes having a low filtration performance and a high Vf value by increasing Vf, and as a result, it is possible to suppress permeation of stimulating vapor phase components, and to increase permeation of semivolatile components (smoking flavor components).

Example 2

1. Preparation of Filter

According to the method similar to the above-described method, any of particles B1 to B3 described below was added to the corrugated film B to prepare particles-containing filter materials B1 to B3, and they were wrapped with filter wrapping papers, thereby preparing filters. Thereafter, the length was adjusted to 20 mm, thereby preparing filters B1 to B3.

Particles B1: Cellulose Particles 86 mg/20 mm
- particle diameter of 28 to 70 mesh, BET specific surface area of less than 5 $m^2/g$
- the particles B1 were prepared by using the commercially available cellulose powder (Endurance MCC VE-090, produced by FMC Corporation) as a raw material, performing compression molding of it using the compression granulator (roller compactor TF-208, manufactured by Freund Corporation), followed by pulverization and classification.

Particles B2: Mixture of Hydrotalcite Particles and Cellulose Particles
- hydrotalcite particles (grade: G-7, purchased from Kyowa Chemical Industry) 41 mg/10 mm,
- particle diameter of 10 to 42 mesh, BET specific surface area of 65 $m^2/g$
- cellulose particles 43 mg/10 mm
- particle diameter of 28 to 70 mesh, BET specific surface area of less than 5 $m^2/g$
- Filter B2 containing both the hydrotalcite particles and the cellulose particles was prepared by connecting the hydrotalcite particles-added 10 mm filter and the cellulose particles-added 10 mm filter.

Particles B3: Activated Carbon Particles (Ch) 76 mg/20 mm
- particle diameter of 28 to 70 mesh, BET specific surface area of 1100 $m^2/g$, commercially available coconut shell-derived activated carbon The filter draw resistances of the filters B1 to B3 were as follows.

Filter B1: 51 [$mmH_2O$/20 mm]
Filter B2: 52 [$mmH_2O$/20 mm]
Filter B3: 52 [$mmH_2O$/20 mm]

2. Preparation of Cigarette

Cigarette 1 was prepared by connecting the filter B1 to the tobacco rod part of Peace Super Lights (JAPAN TOBACCO INC.).

Cigarette 2 was prepared by connecting the filter B2 to the tobacco rod part of Peace Super Lights (JAPAN TOBACCO INC.).

Cigarette 3 was prepared by connecting the filter B3 to the tobacco rod part of Peace Super Lights (JAPAN TOBACCO INC.).

The filters B1, B2, and B3 were connected to the tobacco rod by the following method. Of the filter part (27 mm length, acetate filter) of Peace Super Lights (JAPAN TOBACCO INC.), the original cellulose acetate fiber-filled layer of 7 mm from the downstream end was kept, while the cellulose acetate fiber-filled layer of the part corresponding to the length of 20 mm of the upstream part was removed, and the filter B1 or the filter B3 was inserted (see FIG. 7A).

Figure 7A:
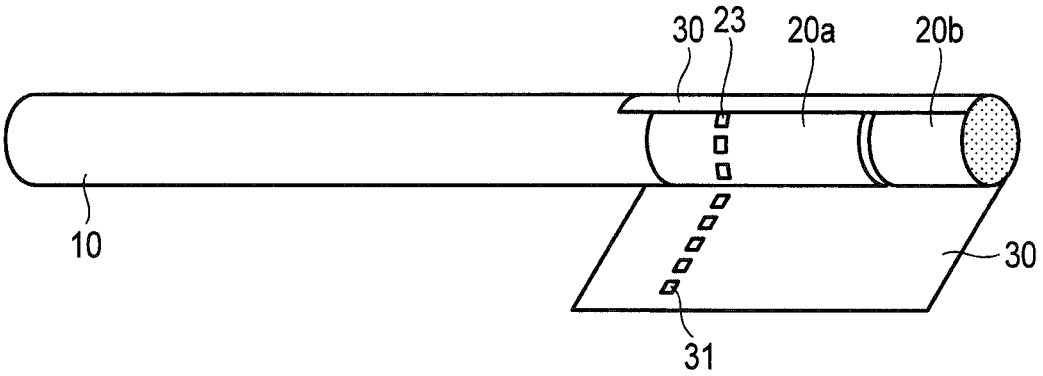
FIG. 7A is a schematic view of a cigarette evaluated in Example 2.
Figure 7B:
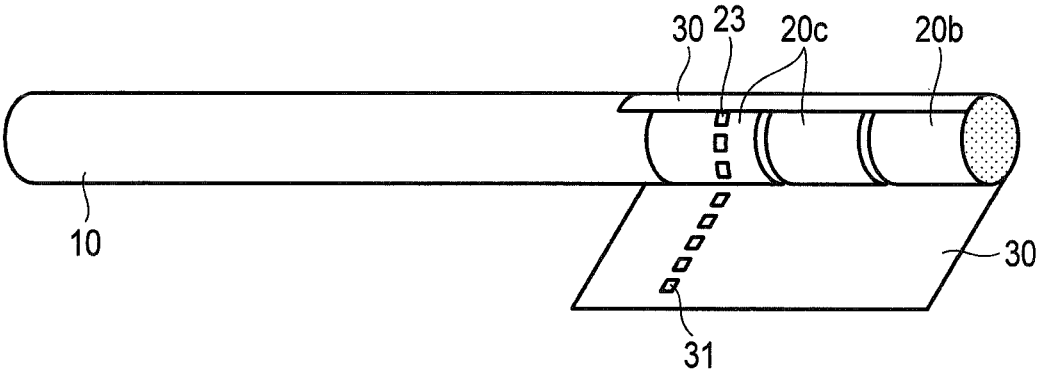
FIG. 7B is a schematic view of the cigarette evaluated in Example 2.

Similarly, of the filter part (27 mm length, acetate filter) of Peace Super Lights (JAPAN TOBACCO INC.), the cellulose acetate fiber-filled layer of the part corresponding to the length of 20 mm of the upstream part was removed, and the filter B2 was inserted (see FIG. 7B). As described above, the filter B2 consists of the two filter segments of the hydrotalcite particles-added filter (10 mm) and the cellulose particle-added filter (10 mm).

When "Evaluation of Permeability of Semivolatile Components" and "Evaluation of Smoking Flavor" were conducted, in order to match the tar value of Peace Super Lights (JAPAN TOBACCO INC.) with the tar values of the cigarettes to which the filters B1, B2, and B3 were connected, the tipping paper was perforated for inflow of diluted air after the filters B1, B2, and B3 were inserted, so that the evaluation was performed with a filter ventilation rate of 37%.

FIGS. 7A and 7B are schematic views of the cigarette evaluated in this example. In FIGS. 7A and 7B, reference numerals denote the following structures.

10: Tobacco rod
20*a*: Filter B1 or B3
20*b*: Cellulose acetate fiber-filled layer
20*c*: Filter B2
23: Perforation of filter wrapping paper
30: Tipping paper
31: Perforation of tipping paper 3. Evaluation 3-1. Evaluation of Permeability of Semivolatile Components For the cigarettes 1 to 3 and the Peace Super Lights (JAPAN TOBACCO INC.) including the acetate filter, the delivery amount of semivolatile components was evaluated.

The delivery amount of semivolatile components was measured as follows.

Automatic smoking was carried out using an automatic smoking machine (RM20D manufactured by Borgwaldt KC, Inc.) under the conditions of a puff volume of 35.0 ml/2 seconds, a puff duration of 2 seconds/puff and a puff frequency of 1 puff/minute. The particulate matter in cigarette smoke was collected with a Cambridge filter (CM-133 manufactured by Borgwaldt KC, Inc.). The smoke passed through the Cambridge filter was collected in 10 mL of methanol cooled to −70° C. with a coolant of dry ice and isopropanol. The resultant methanol solution contains d-32 pentadecane in a concentration of 5 pg/ml as an internal standard substance.

The Cambridge filter having the particulate matter collected, and 10 mL of the methanol solution containing the cigarette smoke collected were transferred to a serum bottle, which was shaken for 30 minutes. After shaking, the supernatant liquid was collected and used as a sample for analysis.

The sample for analysis was analyzed by gas chromatography-mass spectrometry (GC-MSD). Agilent 7890A (Agilent Technologies Inc.) was used for GC, and Agilent 5975C (Agilent Technologies Inc.) was used for MSD.

The peak area of each component (standardized by the internal standard) in the chromatogram obtained by the analysis was compared to the peak area of each component in the chromatogram regarding a control cigarette (Peace Super Lights (JAPAN TOBACCO INC.)), thereby calculating delivery amount ratio of each component.

Limonene, 2,5-dimethylpyrazine, 3-vinylpyridine, 3-butylpyridine, phenylethyl alcohol and indole were measured as semivolatile components.

Figure 6:
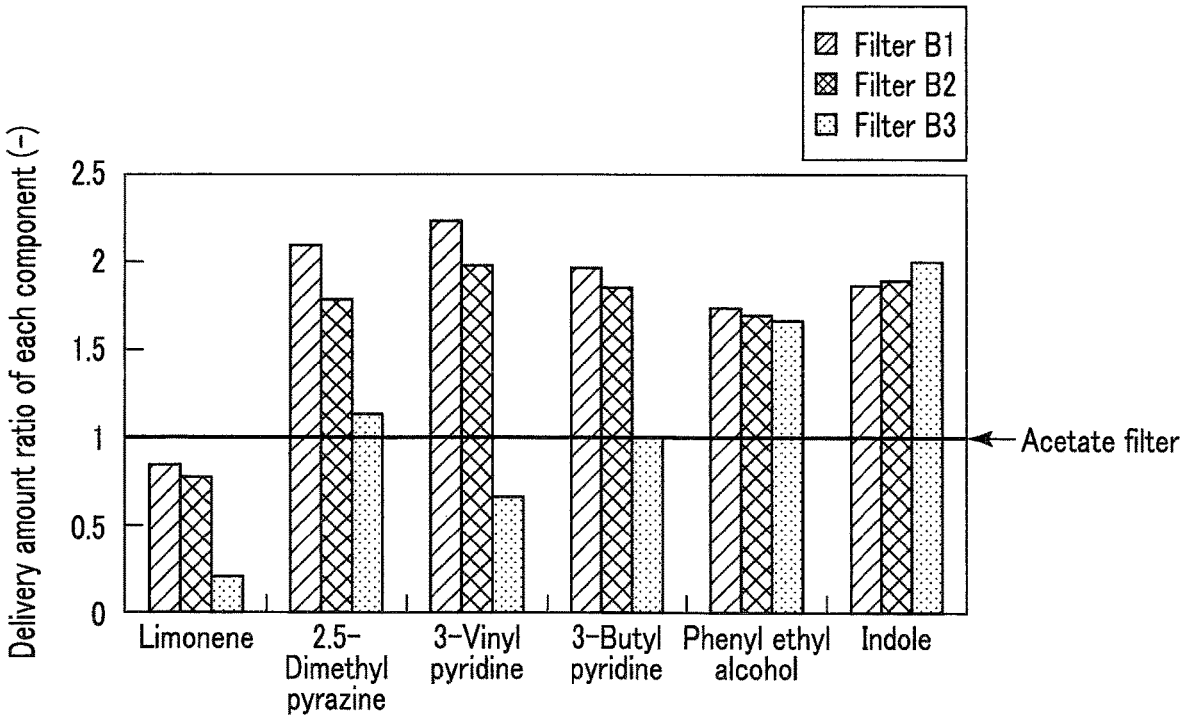
FIG. 6 is a graph showing results of delivery amount ratios of semivolatile components.

FIG. 6 shows the results of the delivery amount ratios of the semivolatile components. The cigarette 1 delivered more semivolatile components with the exception of limonene as compared to Peace Super Lights. The cigarette 2 delivered more semivolatile components with the exception of limonene as compared to Peace Super Lights. The cigarette 3 delivered more semivolatile components with the exception of limonene and 3-vinylpyridine as compared to Peace Super Lights.

This result shows that the filter according to the present invention can provide the user with an enhanced tobacco feeling because of the higher permeation rates of most semivolatile components than the acetate filter.

3-2. Evaluation of Smoking Flavor

Cigarette 4 was prepared in addition to the cigarettes 1 to 3. Specifically, the cigarette 4 was prepared by connecting the filter B2 to the tobacco rod part of MEVIUS ORIGINAL (JAPAN TOBACCO INC.).

For the cigarettes 1 to 4, ten panelists evaluated the smoking flavor.

The cigarette 1 was able to provide the panelists with a strong tobacco feeling as compared to the cigarette including the acetate filter. The cigarettes 2 and 4 provided the panelists with a strong tobacco feeling, and also provided them with a reduced stimulation feeling as compared to the cigarette 1. The cigarette 3 provided the panelists with a strong tobacco feeling and also provided them with a new type flavor with a smooth inhalation feeling as compared to Peace Super Lights.

These results show that the smoking article according to the present invention can provide a user with a gripping comfort, holding comfort with the lips, and biting comfort, all without a sense of discomfort, and can also provide him or her with moderate inhalation resistance and enhanced tobacco feeling. Moreover, through the use of particles having characteristics of selectively removing stimulating components as particles added, the smoking article according to the present invention can also provide a user with an enhanced tobacco feeling while suppressing stimulation. Furthermore, through the use of particles having characteristics of removing whole vapor phase components as particles added, it is possible to provide the user with a new tobacco flavor.

The invention claimed is:

1. A smoking article filter comprising:

a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface, wherein the corrugated film is a plastic film and is impermeable to air, and the filter material is formed by gathering the corrugated film into a plug form such that the ridge portions and valley portions form the plurality of air flow paths each extending in a longitudinal direction of the filter material;

a plurality of particles arranged in the air flow paths; and a filter wrapping paper wrapping the filter material such that the side surface is covered with the filter wrapping paper.

2. The smoking article filter according to claim 1, wherein the corrugated film is a film formed from a melted film material.

3. The smoking article filter according to claim 1, wherein the corrugated film has a thickness of 30 μm to 200 μm.

4. The smoking article filter according to claim 1, wherein the corrugated film has a tensile elongation of 100% or more.

5. The smoking article filter according to claim 1, wherein the corrugated film has a corrugation pitch of 0.5 mm to 1.5 mm.

6. The smoking article filter according to claim 1, wherein the corrugated film is contained at a filling ratio of 10 to 40%.

7. The smoking article filter according to claim 1, wherein the particles have a particle diameter of 12 to 70 mesh based on JIS Z8801-1 (2006).

8. The smoking article filter according to claim 1, wherein the particles are contained in an amount of 20 to 60 mg per 10 mm filter length when a circumference of the filter is 24.0 mm.

9. The smoking article filter according to claim 1, wherein the smoking article filter has a circumference of 16 to 26 mm.

10. The smoking article filter according to claim 1, wherein the film is a film selected from a polypropylene film, a polybutylene succinate film, a polybutylene succinate adipate film, a polyethylene film, a polyvinyl chloride film, a polyethylene telephthalate film, a polylactic acid film, a cellulose acetate film, and a film formed of two or more types of materials constituting said films.

11. The smoking article filter according to claim 1, wherein the particles are particles having a BET specific surface area of 1 to 500 $m^2/g$.

12. The smoking article filter according to claim 1, wherein the particles are particles selected from cellulose particles, cellulose acetate particles, calcium carbonate particles, activated carbon particles with low degree of activation, non-activated carbon particles, and a combination of said particles.

13. The smoking article filter according to claim 1, wherein the particles are particles selected from particles of hydrotalcite compound and particles of anion exchange resin.

14. The smoking article filter according to claim 1, wherein the smoking article filter has a draw resistance of 50 to 140 $mmH_2O$ per 10 mm filter length.

15. The smoking article filter according to claim 1, wherein the smoking article filter has a firmness of 2 to 10 mm*10.

16. A smoking article comprising the smoking article filter according to claim 1.

17. A cigarette, comprising:

the smoking article filter according to claim 1;

a tobacco rod including a tobacco filler and connected to one end of the filter; and a tipping paper wrapped on the filter and the tobacco rod to connect the filter and the tobacco rod.

18. A smoking article filter comprising:

a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface, wherein the corrugated film has a tensile elongation of 100% or more;

a plurality of particles arranged in the air flow paths; and a filter wrapping paper wrapping the filter material such that the side surface is covered with the filter wrapping paper.

19. A smoking article filter comprising:

a filter material having a circular cylinder shape with first and second end surfaces and a side surface, and including a corrugated film with ridge portions and valley portions arranged alternately, the ridge portions and valley portions extending from the first end surface to the second end surface to form a plurality of air flow paths that allow air to flow from the first end surface to the second end surface, wherein the corrugated film is a plastic film and is impermeable to air;

a plurality of particles arranged in the air flow paths; and a filter wrapping paper wrapping the filter material such that the side surface is covered with the filter wrapping paper.

* * * * *